US006091928A

United States Patent [19]

Fuchisawa

[11] Patent Number: 6,091,928

[45] Date of Patent: Jul. 18, 2000

[54] ROLLED PAPER SUPPLY DEVICE FOR IMAGE FORMING APPARATUSES

[75] Inventor: Mitsuru Fuchisawa, Mitaka, Japan

[73] Assignee: Copyer Co., Ltd., Mitaka, Japan

[21] Appl. No.: 09/341,132

[22] PCT Filed: Jan. 13, 1998

[86] PCT No.: PCT/JP98/00086

§ 371 Date: Sep. 2, 1999

§ 102(e) Date: Sep. 2, 1999

[87] PCT Pub. No.: WO98/30483

PCT Pub. Date: Jul. 16, 1998

[30] Foreign Application Priority Data

Jan. 13, 1997 [JP] Japan ..... 9-015938
Feb. 28, 1997 [JP] Japan ..... 9-061772

[51] Int. Cl.[7] ..... G03G 15/00

[52] U.S. Cl. ..... 399/384; 399/385; 399/387

[58] Field of Search ..... 399/384, 385, 399/386, 387; 400/582, 583; 226/24, 27, 45; 271/8.1, 9.01, 9.02, 9.03

[56] References Cited

U.S. PATENT DOCUMENTS 5,708,911 1/1998 Kageyama et al. ..... 399/384 X 5,758,248 5/1998 Yoshiuchi et al. ..... 399/385

*Primary Examiner*—Arthur T. Grimley
*Assistant Examiner*—Hoan Tran
*Attorney, Agent, or Firm*—Oblon, Spivak, McClelland, Maier & Neustadt, P.C.

[57] ABSTRACT

In the case that recording paper of a roll (20) has run out during an image forming process, when the length of a piece of the remaining recording paper left last is longer than the first reference length possible to feed the paper in the inside and outside of a roll unit (RU), the paper is delivered, and when the length of the remaining piece is slightly shorter than the first reference length, the front end of the remaining piece is projected to the outside of the roll unit (RU), and when the length of the remaining piece is shorter than the second reference length impossible to feed the paper in the inside of the roll unit (RU), the remaining piece is dropped inside of the roll unit (RU) by a reverse feeding, thereby, a removal of the remaining piece is facilitated. Thus, the removal of the remaining piece may always be performed well.

8 Claims, 6 Drawing Sheets

ROLLED PAPER SUPPLY DEVICE FOR IMAGE FORMING APPARATUSES

TECHNICAL FIELD

The present invention relates to a rolled paper supply device for an image forming apparatuses such as an electrophotographic copying machine or an electrostatic recording device in which rolled paper is used as recording paper.

BACKGROUND ART

In a variety of image forming apparatus such as an electrophotographic copying machine, generally, an image of a document is read by moving a lighting lamp etc. having image reading means relatively to the document while the document is placed on a document glass stand in the fixed or moved condition, and then an electrostatic latent image corresponding to the document image is formed on an image carrier to perform a development, and the obtained toner image is transferred to recording paper to form the image.

In such image forming apparatus, a roll made of long recording paper wound in a cylindrical shape may be adopted as the recording paper. The wound recording paper is pulled from the roll in synchronization with an image forming process and the pulled recording paper is fed to a transfer part by a rolled paper feeding mechanism and is fed outside after the transfer. The recording paper pulled from the roll is cut in a predetermined length by cutting means such as a cutter. That is, the rolled paper feeding mechanism and cutting means are controlled so as to operate at a predetermined timing by a control part of feeding the rolled paper, thus, the recording paper pulled from the roll can be cut in a required size to use in the cut size.

Then, when the recording paper of the roll has run out during the image forming process, a sensor for detecting the absence or presence of paper located in the proximity of a paper pullout part of the roll detects the last rear end of the recording paper, and the control part of feeding the rolled paper receives a "paper absence signal" emitted from the detecting sensor, thereby, a stop control of the image forming process is performed.

However, in such the conventional apparatus, when the recording paper of the roll has run out, the recording paper cut finally remains at the narrow portion of the feed path, with the result that a takeout operation of the remaining paper may become difficult. That is, if a feeding operation of the recording paper is stopped immediately when the recording paper of the roll has run out, a piece of the remaining recording paper may stop in a difficult state to take out that the piece has been nipped in a nip portion of rollers and the like, for example. Also, when the remaining piece is fed to the outside of the apparatus, the length of the remaining piece may become too short to feed and in this case, the piece of the remaining recording paper cannot be fed to an outlet, thus, the remaining piece may have stayed with its piece nipped in a portion difficult to take out.

Accordingly, to overcome the above problem, it is the first object of the present invention to provide a rolled paper supply device for an image forming apparatuses in which a piece of the remaining recording paper left finally may be handled with the remaining piece always taken out easily when the recording paper of a roll has run out during an image forming process.

Also, in the conventional apparatus mentioned above, when a document has become jammed during the image forming process or the process has become stopped on the way by the fact that an operator pushes a halt key of an image forming operation and so on, by an operation control of the above control part of feeding the rolled paper, the recording paper is pulled from the roll until the pulled paper reaches a size required at the start of the image forming process and then the paper is cut. Then, the recording paper cut in the required size is fed out to handle in the same manner as normal cut paper.

However, in such the conventional apparatus, although the image forming process has become stopped on the way and thereby the image has not become formed, the recording paper is further pulled from the roll until the pulled paper reaches the required size, with the result that the recording paper is wasted by the further pulled paper and also the image forming efficiency is reduced.

Accordingly, it is the second object of the present invention to provide a rolled paper supply device for an image forming apparatus in which a recording paper pulled from a roll may be fed out to handle without waste when a stop has been required during an image forming process.

DISCLOSURE OF INVENTION

To achieve the first object, a rolled paper supply device for an image forming apparatuses according to the present invention includes a roll unit removable to a body of the image forming apparatus and a rolled paper feeding control part, said roll unit integrally holding a roll on which long recording paper is wound cylindrically, a rolled paper feeding mechanism for pulling the recording paper from the roll in synchronization with an image forming process and feeding the pulled paper to a transfer area, cutting means for cutting the recording paper pulled from the roll in a predetermined length, and a paper detecting sensor for sensing a paper absence state of the roll by detecting the rear end of the pull direction of the recording paper pulled from the roll, said rolled paper feeding control part operating the rolled paper feeding mechanism and the cutting means in the roll unit at a predetermined timing to feed and supply the recording paper from the roll, wherein the rolled paper feeding control part has means for delivering a piece of the remaining recording paper when the paper detecting sensor of the roll unit senses the paper absence state of the roll and the length of the piece of the remaining recording paper pulled from the roll at the present time is longer than or equal to a predetermined reference length possible to feed the paper in feed paths of the inside and outside of the roll unit and for projecting the front end of the pull direction of the remaining piece to the outside of the roll unit by a predetermined length when the length of the remaining piece is shorter than the reference length.

According to the feeder as mentioned above, in the case that the recording paper of the roll has run out during the image forming process, when the length of the piece of the remaining recording paper left last is longer than the reference length possible to feed the paper subsequently, the paper is fed to an outlet of the image forming apparatus, and when the length of the remaining piece is shorter than the reference length, the remaining piece is fed only in the inside of the roll unit and the front end of the remaining piece is projected to the outside of the roll unit. Thus, even in any case, the removal of the remaining piece is facilitated.

Also, a rolled paper supply device for an image forming apparatuses according to the present invention includes a roll unit removable to a body of the image forming apparatus and a rolled paper feeding control part, said roll unit integrally holding a roll on which long recording paper is wound cylindrically, a rolled paper feeding mechanism for pulling the recording paper from the roll in synchronization with an image forming process and feeding the pulled paper to a transfer area, cutting means for cutting the recording paper pulled from the roll in a predetermined length, and a paper detecting sensor for sensing a paper absence state of the roll by detecting the rear end of the pull direction of the recording paper pulled from the roll, said rolled paper feeding control part operating the rolled paper feeding mechanism and the cutting means in the roll unit at a predetermined timing to feed and supply the recording paper from the roll, wherein the rolled paper feeding control part has means for delivering a piece of the remaining recording paper when the paper detecting sensor of the roll unit senses the paper absence state of the roll and the length of the piece of the remaining recording paper pulled from the roll at the present time is longer than or equal to a predetermined first reference length possible to feed the paper in feed paths of the inside and outside of the roll unit and for projecting the front end of the pull direction of the remaining piece to the outside of the roll unit by a predetermined length when the length of the remaining piece is shorter than the first reference length and is longer than or equal to a predetermined second reference length possible to feed the paper in the feed paths of the inside of the roll unit and for dropping the remaining piece inside the roll unit by a reverse feeding to the pull direction when the length of the remaining piece is shorter than the second reference length.

According to the feeder as stated above, in the case that the recording paper of the roll has run out during the image forming process, when the length of the piece of the remaining recording paper left last is longer than the first reference length possible to feed the paper in the outside of the roll unit, the paper is fed to an outlet of the image forming apparatus, and when the length of the remaining piece is slightly shorter than the first reference length, the remaining piece is fed only in the outside of the roll unit and the front end of the remaining piece is projected to the outside of the roll unit, and when the length of the remaining piece is shorter than the second reference length impossible to feed the paper in the inside of the roll unit, the remaining piece is dropped inside of the roll unit by the reverse feeding to the normal pull direction. Thus, even in any case, the removal of the remaining piece is facilitated.

Further, a rolled paper supply device for an image forming apparatuses according to the present invention includes a roll unit removable to a body of the image forming apparatus and a rolled paper feeding control part, said roll unit integrally holding a roll on which long recording paper is wound cylindrically, a rolled paper feeding mechanism for pulling the recording paper from the roll in synchronization with an image forming process and feeding the pulled paper to a transfer area, cutting means for cutting the recording paper pulled from the roll in a predetermined length, and a paper detecting sensor for sensing a paper absence state of the roll by detecting the rear end of the pull direction of the recording paper pulled from the roll, said rolled paper feeding control part operating the rolled paper feeding mechanism and the cutting means in the roll unit at a predetermined timing to feed and supply the recording paper from the roll, wherein the rolled paper feeding control part has means for delivering a piece of the remaining recording paper when the paper detecting sensor of the roll unit senses the paper absence state of the roll and the length of the piece of the remaining recording paper pulled from the roll at the present time is longer than or equal to a predetermined reference length possible to feed the paper in feed paths of the inside and outside of the roll unit and for dropping the remaining piece inside the roll unit by a reverse feeding to the pull direction when the length of the remaining piece is shorter than the reference length.

According to the feeder as noted above, in the case that the recording paper of the roll has run out during the image forming process, when the length of the piece of the remaining recording paper left last is longer than the reference length possible to feed the paper, the paper is fed to an outlet of the image forming apparatus, and when the length of the remaining piece is shorter than the reference length, the remaining piece is dropped inside of the roll unit by the reverse feeding to the normal pull direction. Thus, even in any case, the removal of the remaining piece is facilitated.

Next, to attain the second object, a rolled paper supply device for an image forming apparatuses according to the present invention includes a roll on which long recording paper is wound cylindrically, a rolled paper feeding mechanism for pulling the recording paper from the roll in synchronization with an image forming process and feeding the pulled paper to a transfer part, cutting means for cutting the recording paper pulled from the roll in a predetermined length, and a rolled paper feeding control part for operating the rolled paper feeding mechanism and the cutting means at a predetermined timing to supply the recording paper from the roll, wherein the rolled paper feeding control part has means for cutting the recording paper at once by the cutting means and delivering the cut recording paper when the length of the recording paper pulled from the roll is the length possible to feed the paper in the case that the image forming process has become stopped and for cutting the recording paper after pulling the recording paper to the minimum length necessary to feed and delivering the cut recording paper when the length of the recording paper pulled from the roll is not the length possible to feed the paper.

In the feeder as mentioned above, when a halt command is issued during the image forming process, since the recording paper pulled from the roll is cut in the minimum length necessary to feed and is delivered, the recording paper may be efficiently processed in no vain.

Also, in this case, if necessary, the rolled paper feeding control part has means for delivering the cut recording paper at once when the image forming process has become stopped after cutting the recording paper pulled from the roll. By this, the delivery process of the recording paper may be more efficiently performed in no vain.

Further, in the present invention, if necessary, the rolled paper feeding control part has means for stopping a feeding of the recording paper as it is when the front end of the feed direction of the recording paper pulled from the roll is present in the upstream side of the feed direction of the cutting means and for stopping the feeding of the recording paper after returning the front end of the feed direction of the recording paper to the upstream side of the feed direction of the cutting means when the front end of the feed direction of the recording paper pulled from the roll is present in a predetermined range from the cutting means toward the downstream side of the feed direction. By this, the delivery process of the recording paper is simplified more preferably.

Still a further, in the present invention, if necessary, the rolled paper feeding control part has means for cutting the recording paper at once by the cutting means when the recording paper pulled from the roll has become jammed. By this, the removal of the roll unit is facilitated in addition to the effect as described above.

BEST MODE OF CARRYING OUT THE INVENTION

An embodiment of a rolled paper feeder according to the present invention will be described below in detail with reference to the accompanying drawings, and prior to this, an image forming apparatus will be outlined using an example of an electrophotographic copying machine.

Figure 1:
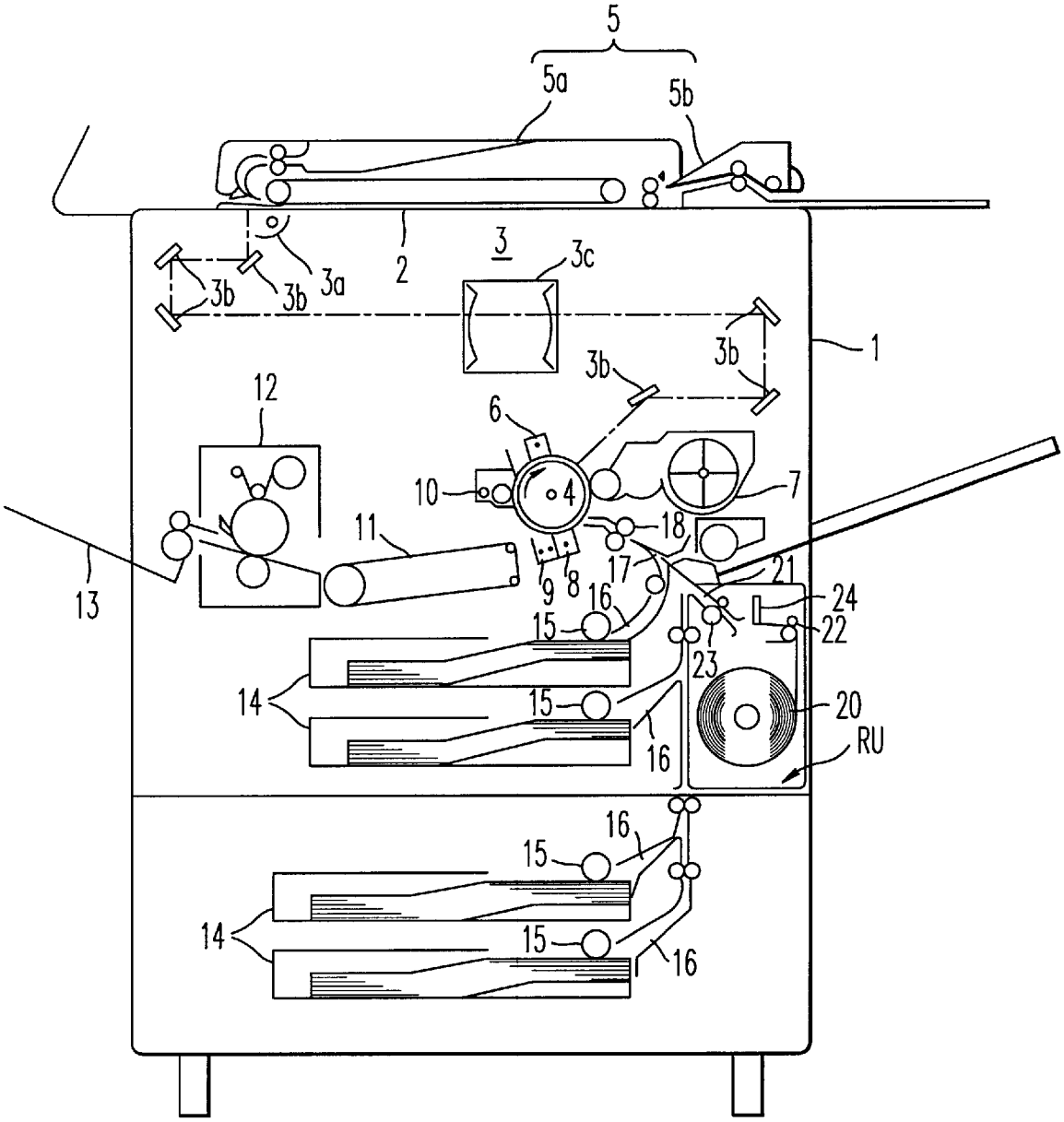
FIG. 1 is a transverse sectional view illustrating a copying machine as an example of an image forming apparatus to which the present invention is applied.

In the electrophotographic copying machine indicated in FIG. 1, a document glass stand 2 used as a stand for placing a document is provided on the top of a body 1 of the copying machine, and a scanner (scanning optical device) 3 constituting image reading means is provided directly below this document glass stand 2. This scanner 3 includes a lighting lamp 3*a* for illuminating the scanning light to a document (not shown) placed on the glass stand 2, reflecting mirrors 3*b* for guiding light reflected from the document on a photoconductive drum 4 described later, and a projection lens 3*c*.

A document feeder 5 is openably provided on the document glass stand 2 with the glass stand 2 covered with the feeder 5. This document feeder 5 comprises a document feeding part (hereinafter referred to as DF) 5*a* for performing a read operation with the lighting lamp 3*a* stopped in a predetermined position and the document fed, that is, sheet through, and an automatic document feeding part (hereinafter referred to as AF) 5*b* for performing the read operation with the document stopped in a predetermined position and the lighting lamp 3*a* moved.

Also, a photoconductive drum 4 acting as an image carrier is provided below the scanner 3 which may be rotated clockwise shown in FIG. 1 at arrow. A charger 6 for uniformly charging the photoconductive drum 4, a developing device 7 for supplying a toner to an electrostatic latent image formed on the drum 4 by exposing the scanning light from the scanner 3 and developing the latent image, a transfer charger 8 located on a paper feed path and for transferring a toner image formed on the drum 4 to the side of recording paper, a separation charger 9 for separating the transferred recording paper from the drum 4, a cleaning device 10 for removing the toner remaining on the drum 4 after the transfer and so on are arranged in the vicinity of the photoconductive drum 4 sequentially along the rotating direction of the drum 4.

Further, a fixing device 12 for thermally fixing the toner image on the recording paper is disposed in the outlet end of a belt-shaped paper feed path 11 extending from the transfer charger 8 and the separation charger 9 toward an outlet of the body of the copying machine, and a paper delivery tray 13 is mounted in an outlet of the fixing device 12. Also, four stages type of paper feed cassettes 14 for storing recording paper of cut sheet by size are provided directly below the paper feed path 11.

Paper feed rollers 15 are respectively disposed above the outlet of the right side (shown in FIG. 1) of each paper feed cassette 14, and feed paths 16 respectively extend from the paper feed rollers 15 of these cassettes 14 toward a transfer part of the photoconductive drum 4. These feed paths 16 are joined in one feed path 17, and resist rollers 18 for feeding the recording paper to the transfer part in synchronization with an image forming process are provided in the vicinity of the transfer part of the joined feed path 17.

Figure 2:
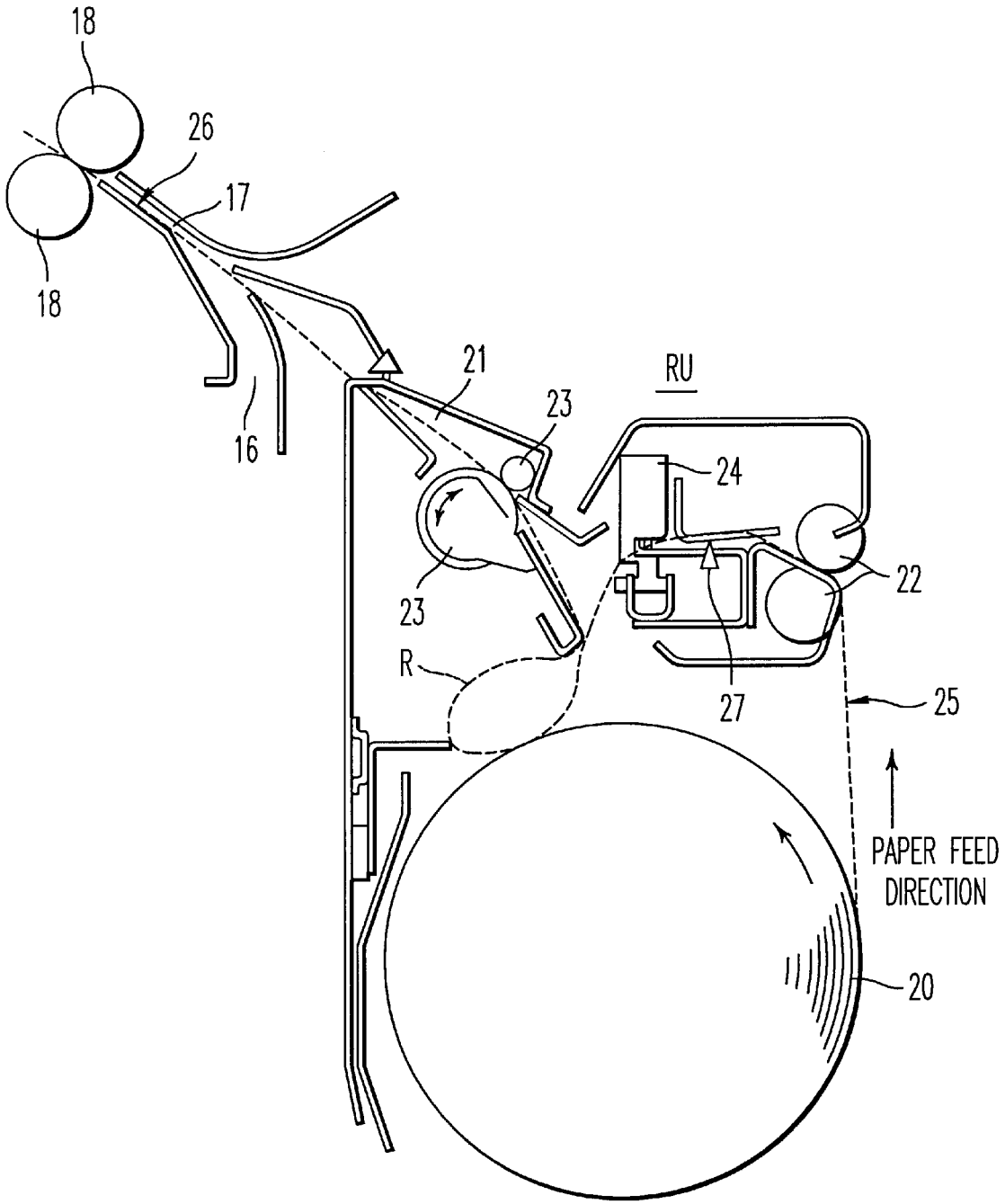
FIG. 2 is an enlarged transverse sectional view of a structure example of a roll unit used in the copying machine shown in FIG. 1.

Next, a structure of the rolled paper feeder will be described. First, a roll unit RU having a roll 20 of the recording paper etc. integrally is provided in the side (rightward in FIG. 1) of the paper feed cassettes 14 so that the roll unit RU may be drawn in the right direction to the body of the copying machine shown in FIG. 1. As shown in FIG. 2, the roll 20 is made by winding long recording paper cylindrically and is replaceably mounted inside the roll unit RU, and when the recording paper of the roll 20 has run out, the roll 20 may be replaced by a new roll.

A feed path 21 for feeding the recording paper pulled from the roll 20 is provided above the roll 20 and this feed path 21 is connected to the joined feed path 17 extending toward resist rollers 18 described above.

Also, paper feed rollers 22 and feed rollers 23 constituting a rolled paper feeding mechanism are disposed respectively upstream and downstream in the direction of feeding on the way of the feed path 21, and by the rotary driving force of these rollers 22 and 23, the recording paper is pulled from the roll 20 in synchronization with a copy operation and the pulled recording paper is fed toward a transfer area.

Also, a cutter 24 used as cutting means for cutting the recording paper pulled from the roll 20 in a predetermined length is provided between the paper feed rollers 22 and the feed rollers 23. This cutter 24 has a rotary blade moving so as to traverse in the direction of paper width and this blade is operated at a predetermined timing by a command from a rolled paper feeding controller described later. Further, the recording paper passing through a cut area of the cutter 24 is fed into the feed rollers 23 after guiding its recording paper in a loop R shape so that the recording may be cut during an image formation.

Still more, a paper detecting sensor 25 for detecting the absence or presence of the recording paper in the roll 20 is disposed in the upstream side of the feeding direction of the paper feed rollers 22. This paper detecting sensor 25 has the function of emitting a paper absence signal by detecting the rear end of the pulled direction of the recording paper when the recording paper pulled from the roll 20 has run out. This paper absence signal is received by the rolled paper feeding controller 30 described later.

Also, a paper feeding sensor 27 for generating a trigger signal for reading the front position of the recording paper and measuring the feed length of the recording paper is disposed in the downstream side (leftward in FIG. 2) of the feeding direction of the paper feed rollers 22. That is, the feed length of the recording paper from the roll 20 is read on the basis of the feed length measured by the paper feed rollers 22 after the paper feeding sensor 27 detects the front end of the recording paper. Also, a resist sensor 26 for detecting the paper feed state to the resist rollers 18 is disposed in the upstream side (rightward in FIG. 2) of the feeding direction of the resist rollers 18, and paper detecting signals from these sensor 25, 26 and 27 are output to the rolled paper feeding controller 30 as described below.

That is, the feeding controller 30 attached to the roll unit RU functions when the roll 20 is specified as the recording paper in the case of performing a sheet through operation etc. using the DF 5*a* described above, and the feeding controller 30 has the function that the recording paper is pulled from the roll 20 at a predetermined timing together with a start of a copy operation and is cut in the specified size by operating the cutter 24 and is fed into the side of the resist rollers 18. Also, the feeding controller 30 has the function of performing a process operation of the remaining recording paper as described later when the recording paper of the roll 20 has run out during the copy operation.

Figure 3:
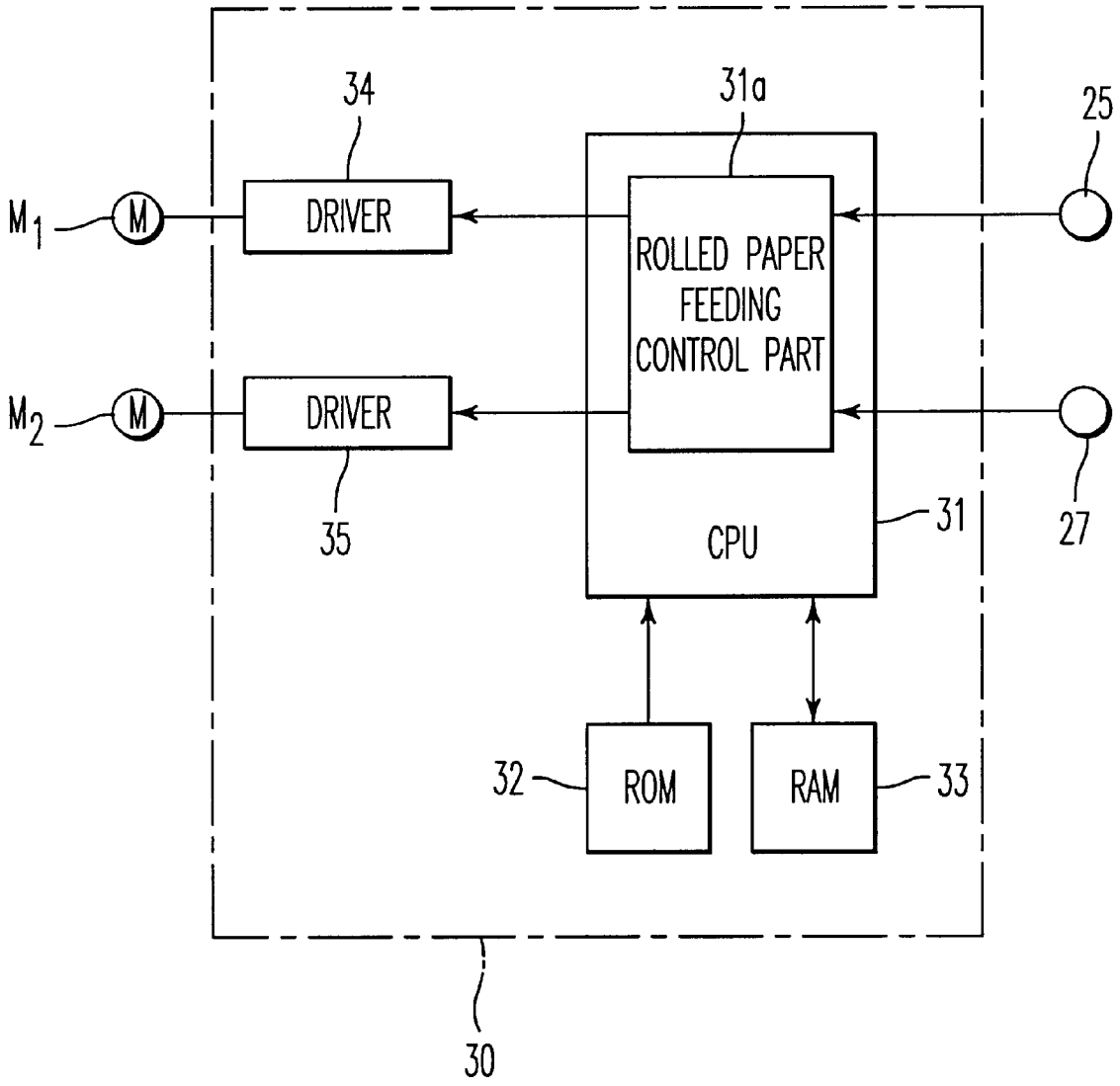
FIG. 3 is a block diagram of a controller for feeding rolled paper according to an embodiment of the present invention.

In the rolled paper feeding controller 30 having a structure as shown in FIG. 3, the paper detecting signals from the paper detecting sensor 25 and the paper feeding sensor 27 disposed in the proximity of an outlet of the roll 20 as well as readout signals from a ROM 32 in which control programs etc. for determining the procedure of feeding and cutting of the recording paper described later are stored and readin and readout signals from a RAM 33 in which a variety of data is stored are input to an input port of a rolled paper feeding control part 31*a* provided in a central processing unit (hereinafter referred to as CPU) 31.

Also, a driver 34 for driving motor M1 of the paper feed rollers 22 and the feed rollers 23 constituting the rolled paper feeding mechanism described above and a driver 35 for driving motor M2 of the cutter 24 are respectively connected to an output port of the control part 31*a* in the CPU 31, and driving signals are output to these driver 34 and 35 at a predetermined timing.

Then, when the recording paper of the roll 20 runs out and the rear end of the pulled direction of a piece of the recording paper pulled out lastly is detected by the paper detecting sensor 25, the paper absence signal from the sensor 25 is output to the rolled paper feeding control part 31*a* of the CPU 31. Then, by this paper absence signal, the piece of the last recording paper pulled from the roll 20 is processed according to the control programs in the ROM 32, for example, as shown in FIG. 4.

Figure 4:
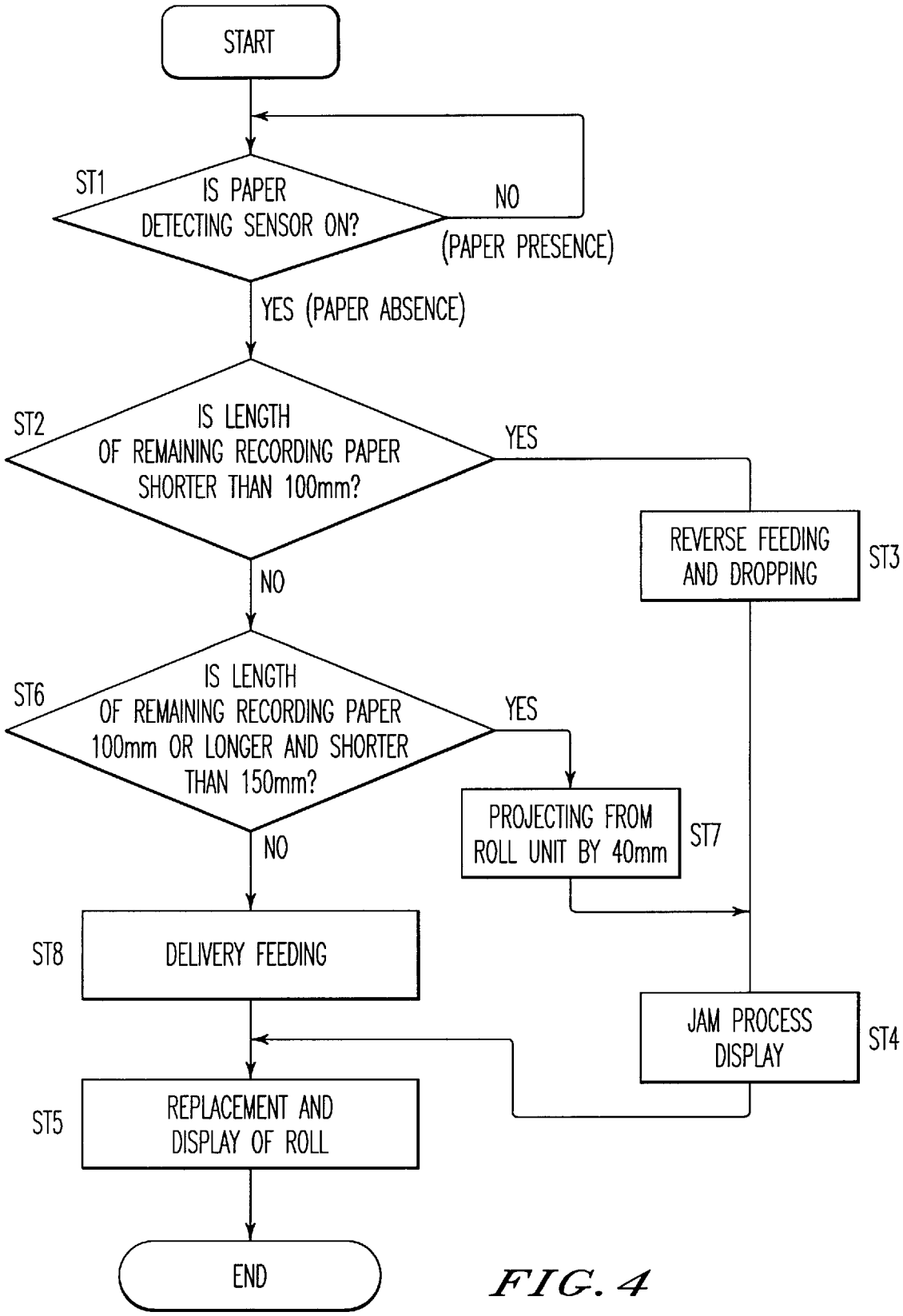
FIG. 4 is a flowchart illustrating a delivery operation of a piece of the remaining recording paper performed by the feeding controller shown in FIG. 3.

That is, when the recording paper of the roll 20 has run out during the copy operation, a control operation shown in FIG. 4 is started and the paper absence signal from the paper detecting sensor 25 is output to the rolled paper feeding control part 31*a* of the CPU 31 (Yes of Step 1). Then, the following control operation is executed according to the feed length of a piece of the last recording paper pulled from the roll 20 at the time (hereinafter referred to as a piece of the remaining recording paper), namely, the length of the piece of the remaining recording paper detected by the paper feeding sensor 27.

First, when the length of the piece of the remaining recording paper is shorter than 100 mm set as an example of the second reference length indicated in the present invention and is shorter than the length of a feed path between the paper feed rollers 22 and the feed rollers 23 inside the roll unit RU (Yes of Step 2), it is decided that the paper cannot be fed inside the roll unit RU and the paper feed rollers 22 are rotated in the direction reverse to the normal feed direction. By this reverse rotation, the remaining piece is fed in the reverse direction and is dropped inside the roll unit RU (Step 3).

Together with this, the message of jam process is displayed (Step 4) and the message of replacement and supply of the roll is displayed (Step 5).

On the contrary, when the length of the piece of the remaining recording paper is 100 mm or longer of the second reference length (No of Step 2), since the length of the remaining piece is longer than the length of the feed path between the paper feed rollers 22 and the feed rollers 23 inside the roll unit RU, it is decided that the paper can be fed inside the roll unit RU and a feed operation of the remaining piece is performed. In this case, the control operation varies as follows according to the length of the remaining piece whether the remaining piece is long or not to such an extent that the paper may be fed in the feed path of the outside of the roll unit RU.

That is, when the length of the piece of the remaining recording paper is longer than that of the distance between the rollers in the feed path of the outside of the roll unit RU, since the remaining piece is not nipped between the rollers in the feed path of the outside of the roll unit RU even if the remaining piece is fed out as it is, the paper can be fed. However, when the length of the remaining piece is shorter than that of the distance between the rollers in the feed path of the outside of the roll unit RU, since the remaining piece is nipped between the rollers, the paper cannot be fed.

Thus, in the present embodiment, since the distance between the resist rollers 18 and the feed rollers 23 is the maximum distance between the rollers in the feed path of the outside of the roll unit RU, the first reference length indicated in the present invention is set at 150 mm as an example corresponding to the distance between the resist rollers 18 and the feed rollers 23. When the length of the piece of the remaining recording paper is shorter than the first reference length, namely, is shorter than 150 mm (Yes of Step 6), it is decided that the paper cannot be fed in the feed path of the outside of the roll unit RU and the paper is fed only inside the roll unit RU. Then, by this inside feeding, the front end of the remaining piece is projected to the outside of the roll unit RU by a predetermined length, for example, 40 mm (Step 7).

After this, in the same manner described above, the message of jam process is displayed (Step 4) and the message of replacement and supply of the roll is displayed (Step 5).

On one hand, when the length of the remaining piece is longer than the first reference length, namely, is 150 mm or longer (No of Step 6), it is decided that the paper can be fed in the feed path of the outside of the roll unit RU and the remaining piece is delivered toward a paper delivery tray 13 (Step 8), and then, the message of replacement and supply of the roll is displayed (Step 5).

In the rolled paper feeder according to the present embodiment as described above, when the recording paper of the roll 20 has run out during the image forming process and the length of the piece of the remaining recording paper left last is longer than the first reference length possible to feed the paper in the inside and outside of the roll unit RU, the remaining piece is pulled out of the roll unit RU and delivered outside the copying machine. Because of this, it is unnecessary to seek the remaining piece.

On the other hand, when the length of the piece of the remaining recording paper is shorter than the first reference length impossible to feed the paper in the outside of the roll unit RU and is longer than the second reference length possible to feed the paper in the inside of the roll unit RU, the paper is fed only inside the roll unit RU and the front end of the remaining piece is projected toward the outside of the roll unit RU by 40 mm. That is, when the roll unit RU is removed from the body of the copying machine, it is unnecessary to seek the remaining piece because the front end of the remaining piece is projected by 40 mm.

Further, when the length of the piece of the remaining recording paper is shorter than the second reference length impossible to feed the paper in the inside of the roll unit RU, the remaining piece is dropped inside of the roll unit RU by a reverse feeding. In this case, since the length of the remaining piece is enough short, the remaining piece may be removed easily.

Thus, even in any cases, it is easy to remove the piece of the remaining recording paper.

In the above embodiment, though the front end of the remaining piece is projected to the outside of the roll unit RU by the predetermined length (40 mm) when the length of the remaining piece is 100 mm or longer and shorter than 150 mm, the remaining piece may also be dropped inside of the roll unit RU by the reverse feeding in the same manner of the case that the length of the remaining piece is shorter than 100 mm. Even in such the manner, a remove of the remaining piece may be facilitated.

Also, in the above embodiment, though the message of jam process is displayed after the reverse feeding when the length of the remaining piece is shorter than the second reference length impossible to feed the paper in the inside of the roll unit RU, without the jam process, an image formation may also be continued by displaying only the message of replacement and supply of the roll and changing the roll for other paper feed means such as paper feed cassettes. Also, the remaining piece dropped inside of the roll unit in this reverse feeding may be removed when the roll is replaced and supplied.

According to the rolled paper feeder of the image forming apparatus of the present embodiment as described above, in the case that the recording paper of the roll 20 has run out during the image forming process, when the length of the piece of the remaining recording paper left last is longer than the reference length possible to feed the paper subsequently, the paper is delivered, and when the length of the remaining piece is shorter than the reference length, the front end of the remaining piece is projected to the outside of the roll unit RU, thereby, the removal of the remaining piece is facilitated. Thus, the removal of the remaining piece may always be performed well, with the result that reliability in the copying machine used as the image forming apparatus may be improved.

Also, according to the rolled paper feeder of the image forming apparatus of the present embodiment, in the case that the recording paper of the roll 20 has run out during the image forming process, when the length of the piece of the remaining recording paper left last is longer than the first reference length possible to feed the paper in the inside and outside of the roll unit RU, the paper is delivered, and when the length of the remaining piece is slightly shorter than the first reference length, the front end of the remaining piece is projected to the outside of the roll unit RU, and when the length of the remaining piece is shorter than the second reference length impossible to feed the paper in the inside of the roll unit RU, the remaining piece is dropped inside of the roll unit RU by the reverse feeding, thereby, the removal of the remaining piece is facilitated. Thus, the removal of the remaining piece may always be performed well, with the result that reliability in the copying machine used as the image forming apparatus may be improved.

Further, according to the rolled paper feeder of the image forming apparatus of the present embodiment, in the case that the recording paper of the roll 20 has run out during the image forming process, when the length of the piece of the remaining recording paper left last is longer than the reference length possible to feed the paper in the inside and outside of the roll unit RU, the paper is delivered, and when the length of the remaining piece is shorter than the reference length, the remaining piece is dropped inside of the roll unit RU by the reverse feeding, thereby, the removal of the remaining piece is facilitated. Thus, the removal of the remaining piece may always be performed well, with the result that reliability in the copying machine used as the image forming apparatus may be improved.

Figure 5:
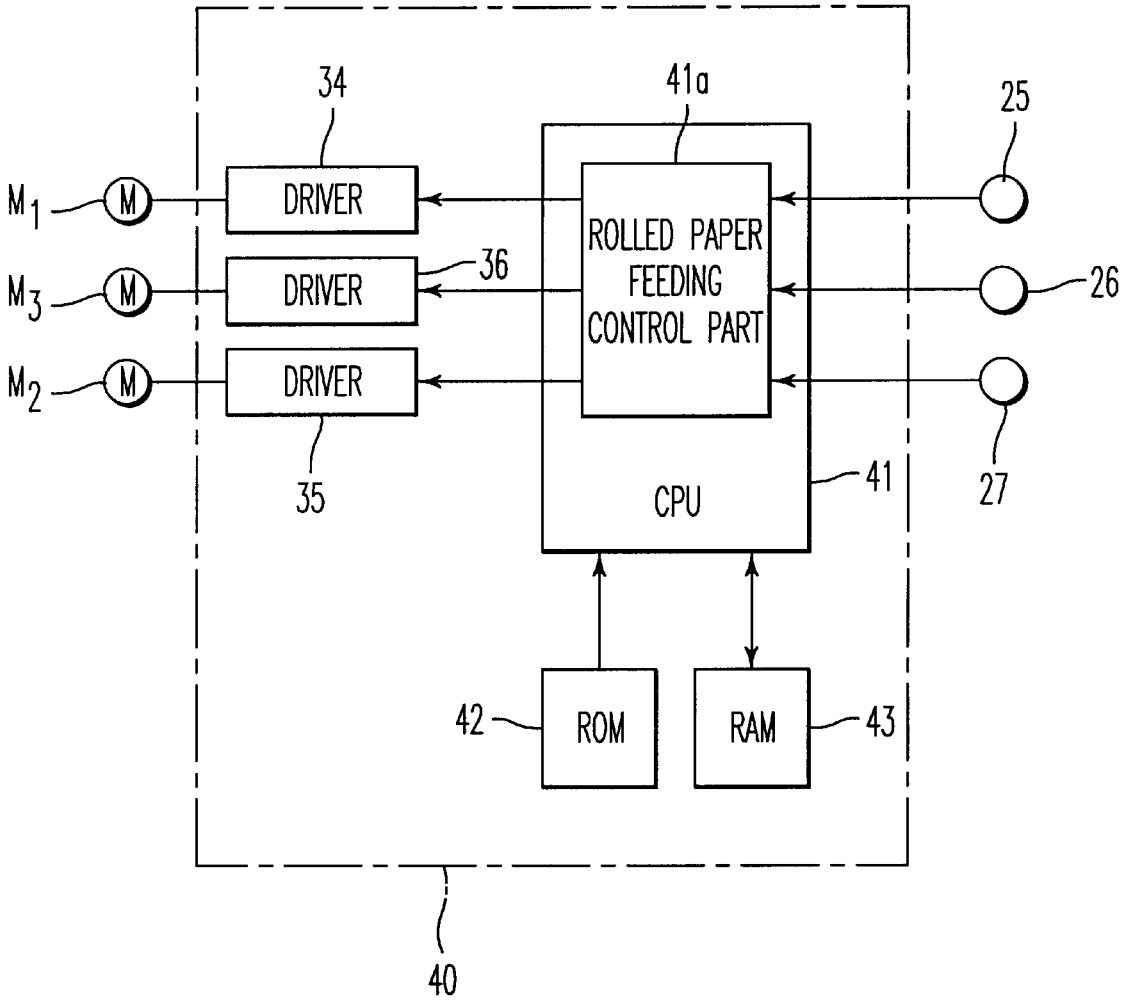
FIG. 5 is a block diagram of a controller for feeding rolled paper according to another embodiment of the present invention.

Next, a rolled paper feeding controller 40 according to another embodiment of the present invention as shown in FIG. 5 will be described.

This rolled paper feeding controller 40 has the function of performing a delivery operation of the recording paper mentioned later when a copy operation has become stopped on the way.

That is, in the rolled paper feeding controller 40 having a structure as shown in FIG. 5, the paper detecting signals from the paper detecting sensor 25, the paper feeding sensor 27 disposed in the proximity of an outlet of the roll 20 and the resist sensor 26 disposed in the proximity of an inlet of the resist rollers 18 as well as readout signals from a ROM 42 in which control programs etc. for determining the procedure of feeding and cutting of the recording paper described later are stored and readin and readout signals from a RAM 43 in which a variety of data is stored are input to an input port of a rolled paper feeding control part 41*a* provided in a central processing unit (hereinafter referred to as CPU) 41.

Also, a driver 34 for driving motor M1 of the paper feed rollers 22 and the feed rollers 23 constituting the rolled paper feeding mechanism described above, a driver 36 for driving motor M3 of the resist rollers 18 and a driver 35 for driving motor M2 of the cutter 24 are respectively connected to an output port of the control part 41*a* in the CPU 41, and driving signals are output to these driver 34, 35 and 36 at a predetermined timing.

Figure 6:
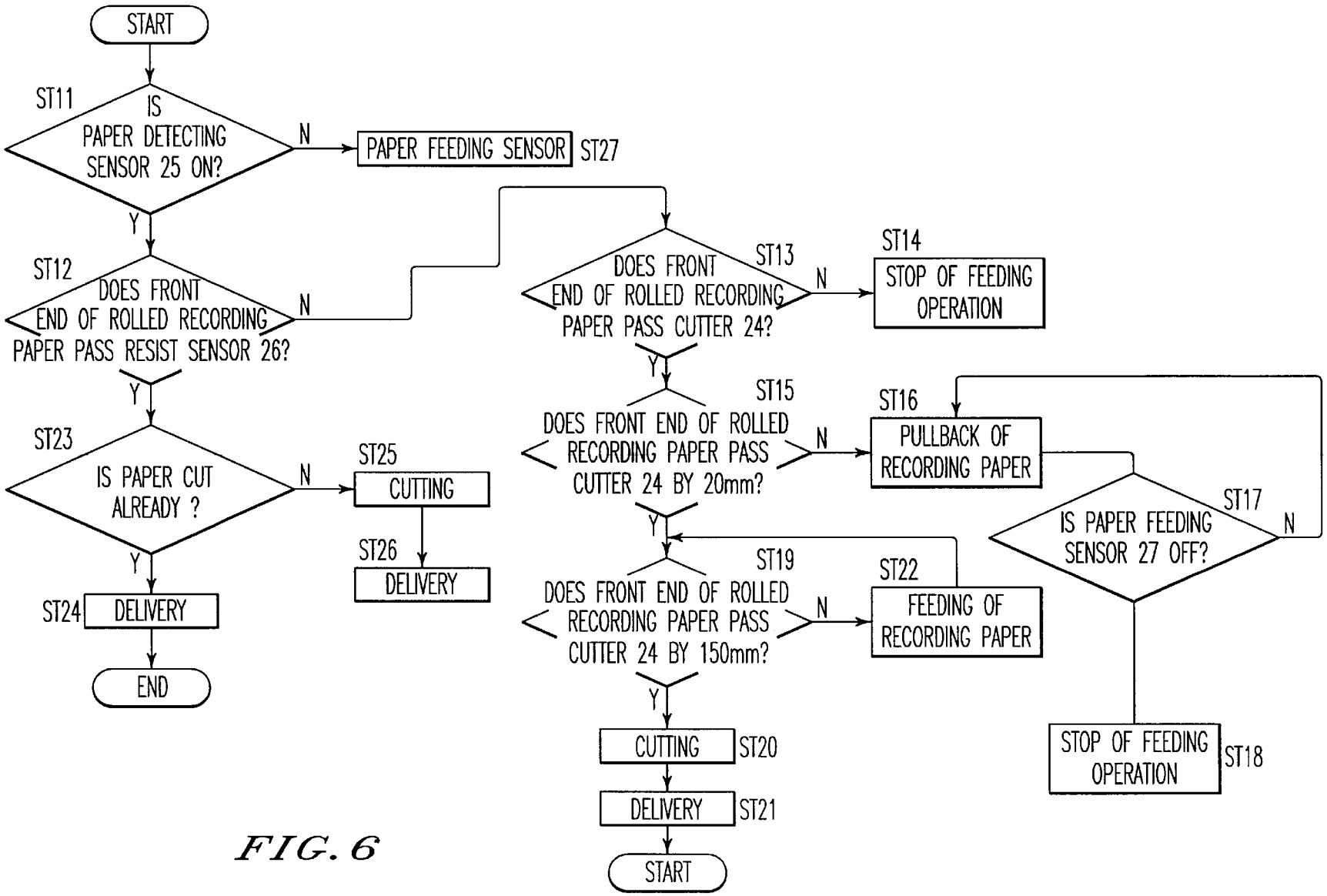
FIG. 6 is a flowchart illustrating a delivery operation of a piece of recording paper performed by the feeding controller shown in FIG. 5.

Then, when a document feeding has become jammed or an operator pushes a copy stop button, a halt command is output to the rolled paper feeding control part 41*a* of the CPU 41 and the copy operation has become stopped on the way. In the stop case, the recording paper pulled from the roll 20 is processed according to the control programs in the ROM 42, for example, as shown in FIG. 6.

That is, when the copy operation has become stopped on the way, first, it is verified that the recording paper is present on the roll 20 by a check of the paper detecting sensor 25 (Yes of Step 11) and then, since the front end of the feed direction of the recording paper pulled from the roll 20 is present in the forward side (the upstream side of the feed direction) of the cutter 24 when the front end of the pulled recording paper does not reach the resist sensor 26 (No of Step 12) and does not reach the cutter 24 (No of Step 13), the feeding operation of the recording paper has been stopped as it is (Step 14).

On the other hand, when the front end of the feed direction of the recording paper pulled from the roll 20 passes the cutter 24 (Yes of Step 13) and the length of the recording paper projected toward the downstream side of the feed direction from the cutter 24 is within about 20 mm set as an example of a predetermined range (No of Step 15), the recording paper is pulled back (Step 16), more particularly, the front end of the feed direction of the recording paper is pulled back to the forward side (the upstream side of the feed direction) of the cutter 24, Then, at the present time that the paper feeding sensor 27 has turned off by this pullback operation (Yes of Step 17), the feeding operation has been stopped (Step 18).

This is because that the recording paper will be transformed if the copy operation is stopped with the recording paper projected from the cutter 24 and the recording paper is stopped on the feed path for a long time.

Further, when the front end of the feed direction of the recording paper pulled from the roll 20 does not reach the resist sensor 26 (No of Step 12) and the length of the recording paper passing the cutter 24 is 20 mm or longer (Yes of Step 15), the control operation varies as follows according to the length of the recording paper projected from the cutter 24 whether the projected length is the length possible to feed the paper or not.

That is, when the length of the recording paper projected from the cutter 24 is longer than that of the distance between the rollers in the subsequent feed path, since the recording paper is not nipped between the rollers even if the recording paper is cut at once, the paper can be fed. However, when the recording paper is cut in the length shorter than the distance between the rollers, since the recording paper is nipped between the rollers, the paper cannot be fed.

Thus, in the present embodiment, since the distance between the resist rollers 18 and the feed rollers 23 is the maximum distance between the rollers in the feed path, it is decided that the paper can be fed even in the subsequent feed path and the process is performed when the projected length of the recording paper is slightly longer than that of the distance between the resist rollers 18 and the feed rollers 23, namely, 150 mm or longer. That is, in the present embodiment, the length of the recording paper projected from the cutter 24 is set at 150 mm or longer as an example of the case the length of the recording paper pulled from the roll 20 indicated in the present invention is the length possible to feed the paper. When the projected length of the recording paper is 150 mm or longer (Yes of Step 19), the recording paper is cut at once (Step 20). Then, the cut recording paper is delivered toward the paper delivery tray 13 (Step 21) and the process is completed.

On the contrary, when the length of the recording paper projected from the cutter 24 is shorter than 150 mm, namely, the length of the recording paper pulled from the roll 20 indicated in the present invention is not the length possible to feed the paper (No of Step 19), since the paper cannot be fed in the subsequent feed path, the recording paper is more fed out by the length short to 150 mm (Step 22). Then, at the present time that the length of the recording paper projected from the cutter 24 has reached 150 mm (Yes of Step 19), the recording paper is cut at once (Step 20) and the cut recording paper is delivered toward the paper delivery tray 13 (Step 21).

When the recording paper of the roll 20 has run out during this delivery operation, the message of a paper absence is displayed back to Step 11 described above after the delivery operation is stopped (Step 27).

Also, when the front end of the feed direction of the recording paper pulled from the roll 20 has already reached the resist sensor 26 (Yes of Step 12), the delivery operation is performed in the substantially same manner described above. In this case, when the size smaller than A3 size is specified, a cutting operation by the cutter 24 is regarded as completion already, with the result that the recording paper is delivered at once (Step 24) when the cutting operation is completed (Yes of Step 23). On the other hand, when it is the size of incompletion of the cutting operation (No of Step 23), the recording paper is cut (Step 25) and then, the cut recording paper is delivered toward the paper delivery tray 13 (Step 26). Also, the rolled paper feeding controller 40 as described above has the function of cutting the recording paper at once when the recording paper itself pulled from the roll 20 has become jammed unlike a feeding jam of the document, and by cutting the recording paper stopped during the feeding, the roll unit RU having the roll 20 may easily be removed from the body 1 of the apparatus.

When the front end of the recording paper has reached the resist sensor 26 particularly, the process is useful since the front end of the recording paper is nipped in the resist rollers 18 and becomes stopped. Also, since the jammed paper is cut, the paper may be removed easily and the image formation may be resumed at once since the front end of the recording paper is located on the paper feeding sensor 27 after the process of the jammed paper.

In the rolled paper feeder according to the present embodiment thus, when the halt command is issued during the image forming operation, namely, the copy operation, since the recording paper pulled from the roll 20 is cut in the minimum length necessary to feed and is delivered, a useless feeding operation of the recording paper is eliminated and a waste of the recording paper may be saved. Thus, the copy operation may be performed efficiently and cheaply, with the result that reliability in the copying machine used as the image forming apparatus may be improved.

INDUSTRIAL APPLICABILITY

Although the invention created by present inventor has been described concretely with reference to preferred embodiments, it is understood that the present invention is not limited to the above embodiments, and various changes and modifications may be made without departing from the spirit of the invention. For example, the present invention may similarly be applied to various image forming apparatus such as a copying machine, a facsimile and a printer.

What is claimed is:

1. A rolled paper supply device for an image forming apparatus including a roll unit removable to a body of the image forming apparatus and a rolled paper feeding control part, said roll unit integrally holding a roll on which long recording paper is wound cylindrically, a rolled paper feeding mechanism for pulling the recording paper from the roll in synchronization with an image forming process and feeding the pulled paper to a transfer area, cutting means for cutting the recording paper pulled from the roll in a predetermined length, and a paper detecting sensor for sensing a paper absence state of the roll by detecting the rear end of the pull direction of the recording paper pulled from the roll, said rolled paper feeding control part operating the rolled paper feeding mechanism and the cutting means in the roll unit at a predetermined timing to feed and supply the recording paper from the roll, wherein the rolled paper feeding control part has means for delivering a piece of the remaining recording paper when the paper detecting sensor of the roll unit senses the paper absence state of the roll and the length of the piece of the remaining recording paper pulled from the roll at the present time is longer than or equal to a predetermined reference length possible to feed the paper in feed paths of the inside and outside of the roll unit and for projecting the front end of the pull direction of the remaining piece to the outside of the roll unit by a predetermined length when the length of the remaining piece is shorter than the reference length.

2. A rolled paper supply device for an image forming apparatus including a roll unit removable to a body of the image forming apparatus and a rolled paper feeding control part, said roll unit integrally holding a roll on which long recording paper is wound cylindrically, a rolled paper feeding mechanism for pulling the recording paper from the roll in synchronization with an image forming process and feeding the pulled paper to a transfer area, cutting means for cutting the recording paper pulled from the roll in a predetermined length, and a paper detecting sensor for sensing a paper absence state of the roll by detecting the rear end of the pull direction of the recording paper pulled from the roll, said rolled paper feeding control part operating the rolled paper feeding mechanism and the cutting means in the roll unit at a predetermined timing to feed and supply the recording paper from the roll, wherein the rolled paper feeding control part has means for delivering a piece of the remaining recording paper when the paper detecting sensor of the roll unit senses the paper absence state of the roll and the length of the piece of the remaining recording paper pulled from the roll at the present time is longer than or equal to a predetermined first reference length possible to feed the paper in feed paths of the inside and outside of the roll unit and for projecting the front end of the pull direction of the remaining piece to the outside of the roll unit by a predetermined length when the length of the remaining piece is shorter than the first reference length and is longer than or equal to a predetermined second reference length possible to feed the paper in the feed paths of the inside of the roll unit and for dropping the remaining piece inside the roll unit by a reverse feeding to the pull direction when the length of the remaining piece is shorter than the second reference length.

3. A rolled paper supply device for an image forming apparatus including a roll unit removable to a body of the image forming apparatus and a rolled paper feeding control part, said roll unit integrally holding a roll on which long recording paper is wound cylindrically, a rolled paper feeding mechanism for pulling the recording paper from the roll in synchronization with an image forming process and feeding the pulled paper to a transfer area, cutting means for cutting the recording paper pulled from the roll in a predetermined length, and a paper detecting sensor for sensing a paper absence state of the roll by detecting the rear end of the pull direction of the recording paper pulled from the roll, said rolled paper feeding control part operating the rolled paper feeding mechanism and the cutting means in the roll unit at a predetermined timing to feed and supply the recording paper from the roll, wherein the rolled paper feeding control part has means for delivering a piece of the remaining recording paper when the paper detecting sensor of the roll unit senses the paper absence state of the roll and the length of the piece of the remaining recording paper pulled from the roll at the present time is longer than or equal to a predetermined reference length possible to feed the paper in feed paths of the inside and outside of the roll unit and for dropping the remaining piece inside the roll unit by a reverse feeding to the pull direction when the length of the remaining piece is shorter than the reference length.

4. A rolled paper supply device for an image forming apparatus including a roll on which long recording paper is wound cylindrically, a rolled paper feeding mechanism for pulling the recording paper from the roll in synchronization with an image forming process and feeding the pulled paper to a transfer part, cutting means for cutting the recording paper pulled from the roll in a predetermined length, and a rolled paper feeding control part for operating the rolled paper feeding mechanism and the cutting means at a predetermined timing to supply the recording paper from the roll, wherein the rolled paper feeding control part has means for cutting the recording paper at once by the cutting means and delivering the cut recording paper when the length of the recording paper pulled from the roll is the length possible to feed the paper in the case that the image forming process has become stopped and for cutting the recording paper after pulling the recording paper to the minimum length necessary to feed and delivering the cut recording paper when the length of the recording paper pulled from the roll is not the length possible to feed the paper.

5. A rolled paper supply device for an image forming apparatus according to claim 4, wherein the rolled paper feeding control part has means for delivering the cut recording paper at once when the image forming process has become stopped after cutting the recording paper pulled from the roll.

6. A rolled paper supply device for an image forming apparatus according to claim 4, wherein the rolled paper feeding control part has means for stopping a feeding of the recording paper as it is when the front end of the feed direction of the recording paper pulled from the roll is present in the upstream side of the feed direction of the cutting means and for stopping the feeding of the recording paper after returning the front end of the feed direction of the recording paper to the upstream side of the feed direction of the cutting means when the front end of the feed direction of the recording paper pulled from the roll is present in a predetermined range from the cutting means toward the downstream side of the feed direction.

7. A rolled paper supply device for an image forming apparatus according to claim 4, wherein stop states of the image forming process are a jam state of a document feeding or an output state of a halt command by an operator.

8. A rolled paper supply device for an image forming apparatus according to claim 4, wherein the rolled paper feeding control part has means for cutting the recording paper at once by the cutting means when the recording paper pulled from the roll has become jammed.

* * * * *